US005816960A

United States Patent [19]

Svoma et al.

[11] Patent Number: 5,816,960

[45] Date of Patent: Oct. 6, 1998

[54] HANDLE AND GRIP FOR SPORTS RACKETS

[75] Inventors: Rodney Svoma; James Speros, both of Phoenix, Ariz.; Gene A. Broadman, Livermore, Calif.

[73] Assignee: Athletics Alternatives, Inc., Phoenix, Ariz.

[21] Appl. No.: 484,449

[22] Filed: Jun. 7, 1995

Related U.S. Application Data

[60] Division of Ser. No. 38,988, Mar. 29, 1993, Pat. No. 5,551,669, which is a continuation-in-part of Ser. No. 233, 228, Aug. 18, 1988, Pat. No. 5,037,097.

[51] Int. Cl.[6] ..... A63B 49/08

[52] U.S. Cl. ..... 473/549

[58] Field of Search ..... 273/738, 75, 73 R, 273/73 C; 473/298, 299, 300, 549, 552, 523

[56] References Cited

U.S. PATENT DOCUMENTS

| | | | |
|---|---|---|---|
| 4,033,583 | 7/1977 | Ehrhart | 273/73 J X |
| 4,101,125 | 7/1978 | Heath | 273/73 J X |
| 4,149,721 | 4/1979 | Strickland | 273/73 J |
| 4,826,168 | 5/1989 | McGuire et al. | 473/299 X |
| 5,071,125 | 12/1991 | Shen | 273/73 J X |
| 5,169,145 | 12/1992 | Jang | 273/73 J |
| 5,236,198 | 8/1993 | Haines et al. | 273/73 J X |

FOREIGN PATENT DOCUMENTS

| | | | |
|---|---|---|---|
| 130620 | 1/1985 | European Pat. Off. | 273/73 J |
| 130623 | 1/1985 | European Pat. Off. | 273/73 J |
| 134473 | 3/1985 | European Pat. Off. | 273/73 J |
| 2480607 | 10/1981 | France | 273/73 J |
| 2590802 | 6/1987 | France | 273/73 J |
| 2540388 | 8/1984 | Japan | 273/73 J |
| 323485 | 1/1930 | United Kingdom | 273/73 J |
| 498430 | 1/1939 | United Kingdom | 273/73 J |

*Primary Examiner*—Raleigh W. Chiu
*Attorney, Agent, or Firm*—Berthold K. J. Weis

[57] ABSTRACT

A sports racket having a grip which is removably joined to a handle integral with the frame of the racket, particularly by means of a compressible, flexible coupling disposed between the handle portion of racket frame and the grip to thereby absorb shock and vibration and prevent their transmission from the racket to the hand of the player.

5 Claims, 1 Drawing Sheet

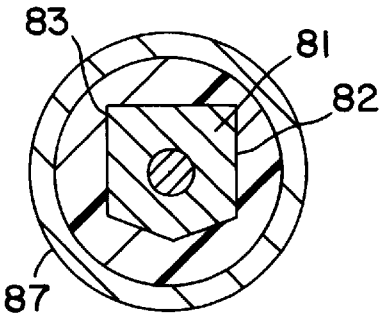
FIG. IB
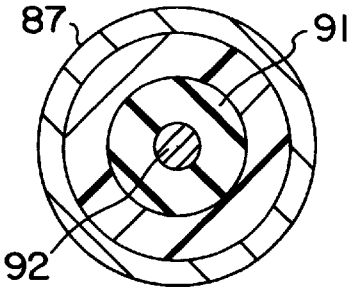
FIG. ID
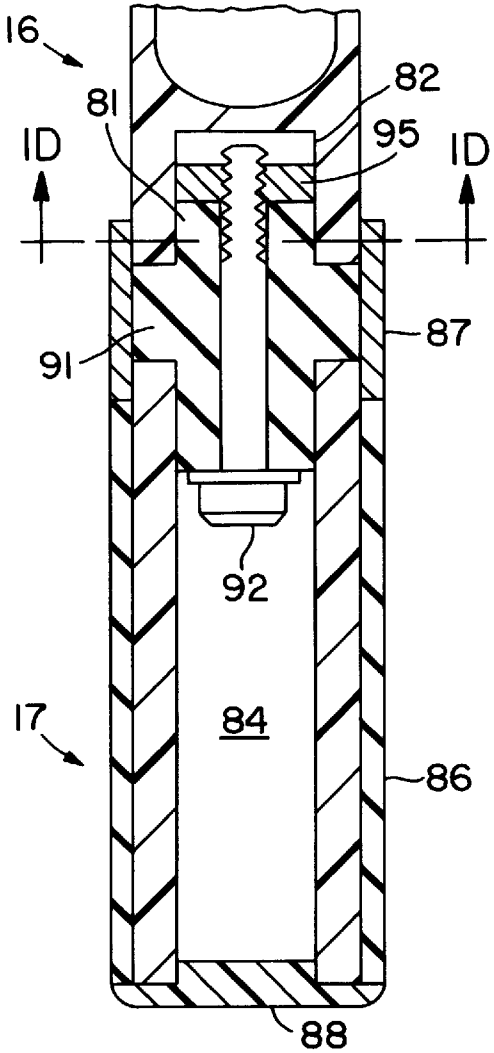
FIG. IC
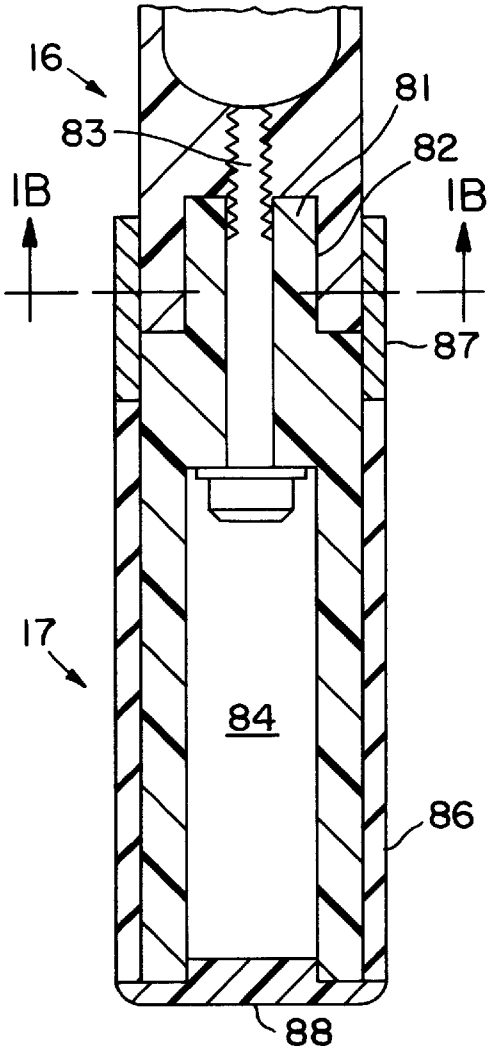
FIG. IA

HANDLE AND GRIP FOR SPORTS RACKETS

CROSS REFERENCE TO RELATED APPLICATIONS

This application is a divisional application of application Ser. No. 08/038,988, filed on Mar. 29, 1993, now U.S. Pat. No. 5,551,669, issued Sep. 3, 1996, which in turn is a continuation-in-part of our application Ser. No. 07/233,228 entitled "Improved Sports Racket", filed Aug. 18, 1988, by the same inventors U.S. Pat. No. 5,037,097.

FIELD OF THE INVENTION

This invention generally relates to sports rackets, such as rackets for the games of tennis, racket ball, squash, badminton, or the like, which are comprised of a webbed netting strung from a frame, and more particularly to grips and handles for such rackets, particularly grips which are removable, and are joined to the handle by means of flexible couplings capable of absorbing shock and vibration.

BACKGROUND OF THE INVENTION

The highly competitive modern game of tennis places ever increasing demands on performance characteristics of rackets. An important aspect relates to racket strength or stiffness versus weight. Modern materials are typically fiber reinforced thermoplastic or thermosetting resins, and light-weight metals or their alloys. In order to save weight with minimum sacrifice in strength, it has long been recognized that it is desirable to provide rackets of hollow, or tubular construction.

OBJECTS OF THE INVENTION

It is therefore a principal object of the invention to provide a racket frame configuration comprised of component pieces which can be readily and economically manufactured and assembled.

Another object of the invention is to provide a hollow racket which can be made from compression molded parts.

Yet another object of the invention is to provide a racket frame of superior mechanical and dynamic response properties.

Still another object of the invention is to provide a racket frame construction which complements the splayed string suspension system of the present invention and that of the parent case.

Yet another object of the invention is to provide a frame-string suspension combination, where the strings contribute to the mechanical integrity of the frame.

Still another object of the invention is to provide a handle-grip system which can be easily fitted and assembled at retail outlets.

A further object of the invention is to provide a handle-grip combination where the grip contributes to the integrity of the frame assembly.

These and other objects of the invention will become apparent to those skilled in the art upon consideration of the following description, drawings and claims.

SUMMARY OF THE INVENTION

The above and other objects of the invention are achieved by providing a sports racket having the following major aspects:

A first aspect relates to a frame which comprises at least two pieces which are joined together along a plane substantially parallel to the playing surface, particularly including rackets comprised of frame half sections joined together in a plane coincident with the central plane through the playing surface of the racket. It will be readily apparent that this construction permits the formation of a racket frame having hollow interiors and, moreover, by appropriate selection of a stringing arrangement, may be made from identical halves. This aspect of the invention is the subject of our U.S. Pat. No. 5,551,689, of which this case is a divisional.

A second major aspect relates to the stringing system which lead to and makes the present racket frame construction possible. Our previously filed application referenced above now U.S. Pat. No. 5,197,731 discusses such systems of stringing rackets extensively and its disclosure in expressly incorporated herein by reference. U.S. Pat. No. 4,802,678 entitled "Sports Racket" issued on Feb. 7, 1989 to Rodney Svoma, also a co-inventor in this case, relates to the present stringing systems as well.

Another aspect of the invention relates to the handle. The invention envisions providing suppliers with a wider assortment of sizes or styles for improved fitting for players according to hand size and preference. In the simplest execution of the concept the grip comprises a tubular sleeve, which fits a cylindrical handle of matching cross-sections. A desired grip may be attached by means of adhesive supplied with the racket. For a more sophisticated version the handle portion of the frame is terminated with a keyed recess which fittingly engages projections of all grip. A chosen grip is then inserted in the keyed recess and secured to the handle by bolting and/or adhesive. The keyed recess and projections are configured to permit insertion of the handle with the correct orientation only. Preferably the joint between the racket and the grip includes a resilient member such as hard rubber which prevents the transmission of vibrations from the racket to the player. In a preferred version, the hard rubber member may be axially compressed and radially expanded to form a tight joint with the handle and the grip.

BRIEF DESCRIPTION OF THE DRAWINGS

Embodiments of the invention will be described in detail with reference to the following drawings, in which FIGS. 1*a* and 1*e* show the handle assembly in longitudinal cross-section and FIGS. 1*b* and 1*d* show versions of the handle and grip in transverse cross-section.

THE HANDLE

Sports rackets having frames and stringing arrangements as described above may, of course, be outfitted with conventional handles and grips. The proper sizing and type of grips is an important element in a player's selection of sports rackets. The present rackets being relatively sophisticated means that a supplier would have to make a substantial investment in an inventory of rackets, in order to be prepared to accommodate the needs and preferences of customers regarding grips. Grips being far less expensive than rackets, it is intended to provide rackets and grips separately, so as to permit assembly at the supplier's place of business and reduce the value of inventory necessary to be on hand. The simplest version may be a tubular sleeve which fits over the terminal end of the handle, where it may be glued in place by the supplier.

FIGS. 1*a* and 1*b* illustrate a preferred racket handle and grip configuration in longitudinal and transverse cross-section. With reference to these figures, the numeral 16 refers to the handle portion of the frame extending from the heel portion of a racket, as discussed in detail in our U.S. Pat. No. 5,551,689, and numeral 17 refers to the grip, which may terminate in a protrusion 81 which fits the keyed recess 82 in one orientation only. Handle and grip of this variation are bolted together. Bolt 83 can be inserted and tightened rapidly at the premises of the supplier by means of conventional tools through access channel 84. The body of the grip is surrounded with covering 86. Grips of different sizes and coverings can be made available for fitting a racket. Collar 87 and access channel cover 88 are readily pressed in place for finish.

Shown in FIG. 1*c* and 1*d* is a preferred version with resilient transition elements 91, made of a material such as hard rubber. Handle and grip are securely fastened together by means of through-bolt 92 which is threaded into nut 95 and thereby axially compresses and laterally expands the hard rubber element to securely engage both handle and grip. Grip and handle are readily separated by loosening the bolt, rendering the grip removable and interchangeable. A major purpose is to reduce the transmission of shock and vibration from the racket to the player. In addition to bolting, the assembly may be joined by means of adhesive, however grips would then no longer be interchangeable.

Having thus described the invention, it will be apparent to those skilled in the art that numerous variations may be made without departing from the spirit and scope of the invention, which should therefore be limited only by the following claims.

We claim:

1. A sports racket comprising a frame having a handle, a grip and a flexible coupling disposed between said handle and said grip, said coupling engaging and being removably secured to said handle, wherein said handle defines a recess, and said flexible coupling defines a protrusion for fittingly engaging said recess, and wherein said coupling is removably secured to said handle by said protrusion being axially compressed and laterally expanded to form a joint with said recess in said handle.

2. The sports racket of claim 1, wherein said protrusion and recess are keyed to fit together in one orientation only.

3. The sports racket of claim 1, wherein said flexible coupling is made of rubber.

4. The sports racket of claim 1, wherein said flexible coupling is axially compressed and laterally expanded by means of a bolt.

5. A sports racket comprising a frame having a handle, a grip, said handle and said grip defining recesses, and a flexible coupling disposed between said handle and said grip, said coupling defining protrusions for fittingly engaging said recesses, and a through-bolt for axially compressing and laterally expanding said coupling to engage and removably secure said coupling to said handle and said grip.

* * * * *